US005365728A

United States Patent [19]

Mack

[11] Patent Number: 5,365,728

[45] Date of Patent: Nov. 22, 1994

[54] RAIL CONVEYOR SYSTEM FOR ROVING BOBBINS IN A SPINNING MILL

[75] Inventor: Karl-Heinz Mack, Weilheim, Germany

[73] Assignee: Zinser Textilmaschinen GmbH, Ebersbach/Fils, Germany

[21] Appl. No.: 50,904

[22] Filed: Apr. 20, 1993

[30] Foreign Application Priority Data

Apr. 21, 1992 [DE] Germany ..... 4213122

[51] Int. Cl.[5] ..... D01H 11/00; D01H 13/26

[52] U.S. Cl. ..... 57/281; 57/90; 242/35.5 A

[58] Field of Search ..... 57/90, 281; 198/347.4, 198/358, 347.3; 242/35.5 A; 104/91, 88

[56] References Cited

U.S. PATENT DOCUMENTS

| | | | |
|---|---|---|---|
| 3,530,571 | 12/1967 | Perry | 198/358 X |
| 3,828,682 | 8/1974 | Klein | 57/281 X |
| 3,834,315 | 9/1974 | Warner | 104/88 |
| 3,935,821 | 2/1976 | Maier et al. | 57/281 X |
| 4,053,741 | 10/1977 | Ainoya et al. | 198/358 X |
| 4;554,873 | 11/1985 | Rex | 104/88 |
| 4,841,719 | 6/1989 | Sasaki et al. | 57/281 |
| 5,148,665 | 9/1992 | Kidani | 57/281 |
| 5,287,895 | 2/1994 | Raaijmakers et al. | 104/91 X |

FOREIGN PATENT DOCUMENTS

| | | | |
|---|---|---|---|
| 392482 | 10/1990 | European Pat. Off. | 57/281 |
| 0401828 | 12/1990 | European Pat. Off. . | |
| 0431268 | 6/1991 | European Pat. Off. . | |
| 0454897 | 6/1991 | European Pat. Off. . | |
| 2227105 | 12/1973 | Germany . | |
| 3601832 | 7/1987 | Germany . | |
| 3734506 | 7/1990 | Germany . | |
| 61-215724 | 9/1986 | Japan . | |

OTHER PUBLICATIONS

Chemiefasern/Textilindustrie, 37/89. Jahrgang, Dec. 1987, pp. 1262 & 126 Spinnerei; "Transport-und Lagersysteme in der Spinnerei" no translation.

*Primary Examiner*—Daniel P. Stodola
*Assistant Examiner*—William Stryjewski
*Attorney, Agent, or Firm*—Herbert Dubno; Andrew M. Wilford

[57] ABSTRACT

A conveyor-storage system for moving bobbins in a spinning plant between a fly frame, a ring-spinning frame, and a bobbin cleaner has an annular track having a first section extending from the fly frame to the ring-spinning frame, a second section extending from the ring-spinning frame to the cleaner, and a third section extending from the cleaner to the fly frame. A single large-capacity storage area immediately adjacent the track has respective first, second, and third feed tracks extending to the respective track sections. Respective first, second, and third three-point intersections connect each feed track with the respective track section for two-way movement of bobbins between each feed track and the respective track section.

4 Claims, 2 Drawing Sheets

RAIL CONVEYOR SYSTEM FOR ROVING BOBBINS IN A SPINNING MILL

FIELD OF THE INVENTION

The present invention relates to a rail conveyor system. More particularly this invention concerns such a conveyor system for transporting roving bobbins and sleeves in a spinning mill.

BACKGROUND OF THE INVENTION

A standard spinning operation has three main subsystems: the roving or fly frame, the ring-spinning frame, and the bobbin cleaner. The roving is reduced in two stages to yarn in the fly and ring frames, and in the cleaner the bobbins are stripped of any scraps of roving that remain attached to them so they can be recirculated to the fly frame.

Typically an annular track-type conveyor system is provided from which the bobbins hang as they move from subsystem to subsystem. Since, however, the capacities of the various subsystems invariably are different and even vary somewhat, it is necessary to provide some storage arrangement so that when, for instance, the roving subsystem outputs too many roving bobbins, some of them can be stored until the ring-spinner has some extra capacity and can handle them. Similarly the cleaner typically only works on a single bobbin at a time, albeit very quickly, so that it cannot deal with the bobbins that arrive in batches or so-called trains. Thus it is necessary to provide a shunting arrangement and a storage facility between each subsystem and the next one.

In European patent publication 401,828 of S. Kidana et al (based on a Japanese priority of 09 Jun. 1989) and German 3,601,832 of H. Güttler (filed in Germany 22 Jan. 1986) an annular track system is shown with movement in a single direction. U.S. Pat. No. 5,148,665 and equivalent European patent publication 454,897 of S. Kidani (based on a Japanese priority of 28 Apr. 1990) have storage shunts that are fed from one end with two-way traffic into and out of them. This open rail system can have one or more tracks as described in European patent publication 431,268 of M. Erni (based on a Swiss priority of 18 Oct. 1989) and three different storage systems. Closed systems normally have the advantage over open systems that, due to the one-way movement of the bobbin-holding carriages, a single track can be used rather than the more complex two-track arrangement of the open storage systems.

Both the flyers and the ring spinners need a supply of fresh spools, loaded in the one case and empty in the other, as they work. This resupply typically takes place batch-wise so that the storage or buffer systems are used as described in German 2,227,105 of K. Klein (filed in Germany 03 Jun. 1972). This single-track system has storage areas that take full and empty bobbins, but no provision is made for cleaning the bobbins.

Closed storage systems such as described in Japanese 61-215,724 have two or more separate storage systems when they are provided with a bobbin cleaner. Such an arrangement is further described in the Zinser in-house publication "Konzept der Ringspinnerei" (concept of ring spinning).

The discontinuous supply and demand of bobbins and/or sleeves in all three subsystems thus normally requires three different buffer/storage systems. Thus between the flyers and the ring-spinning machines there is normally a storage facility with a somewhat larger capacity than the ones between the ring-spinners and the cleaner and between the cleaner and the flyers. Both empty and full bobbins must be stored in the storage unit between the flyers and the ring spinners, while the other two buffer-storage areas only hold essentially empty bobbins. Since a flyer subsystem normally does not have more than 120 spindles, the storage facilities associated therewith do not have to have much larger capacity.

There is therefore a tradeoff in designing such systems between, on the one hand, providing the largest possible buffers and thereby going to considerable expense and taking up considerable space and, on the other hand, minimizing buffer size, cost, and space requirements and thereby running the risk of putting a bottleneck in the production facility.

OBJECTS OF THE INVENTION

It is therefore an object of the present invention to provide an improved rail conveyor/storage system for a spinning mill.

Another object is the provision of such an improved rail conveyor/storage system for a spinning mill which overcomes the above-given disadvantages, that is which avoids the disadvantages of too-small buffers while being fairly inexpensive and efficient with respect to use of space.

SUMMARY OF THE INVENTION

A conveyor-storage system for moving bobbins in a spinning plant between a fly frame, a ring-spinning frame, and a bobbin cleaner has according to the invention an annular track having a first section extending from the fly frame to the ring-spinning frame, a second section extending from the ring-spinning frame to the cleaner, and a third section extending from the cleaner to the fly frame. A single large-capacity storage area immediately adjacent the track has respective first, second, and third feed tracks extending to the respective track sections. Respective first, second, and third three-point intersections connect each feed track with the respective track section for two-way movement of bobbins between each feed track and the respective track section.

Thus with the system of this invention a single buffer/storage system is used that services all three systems of the spinning mill. The capacity of this system can be set to accommodate the widest possible differences in capacity, typically that between the flyer and the spinner, and can ensure continuous production of all subsystems. In practice it is possible to use the fairly large buffer normally provided between the flyer and the spinner, and merely to connect it via the inventive feed tracks also to the track sections leading to and from the cleaner to allow it to service the entire system. Of course it is also within the scope of this invention to provide a wholly new storage system, in particular when not retroffiting to an existing installation.

According to the invention the storage area lies wholly within the annular track. It has a plurality of track sections from which the bobbins can hang and a drive is provided for displacing the bobbins along the sections and through the intersections, and a controller for operating the drive and the intersections for moving the bobbins.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
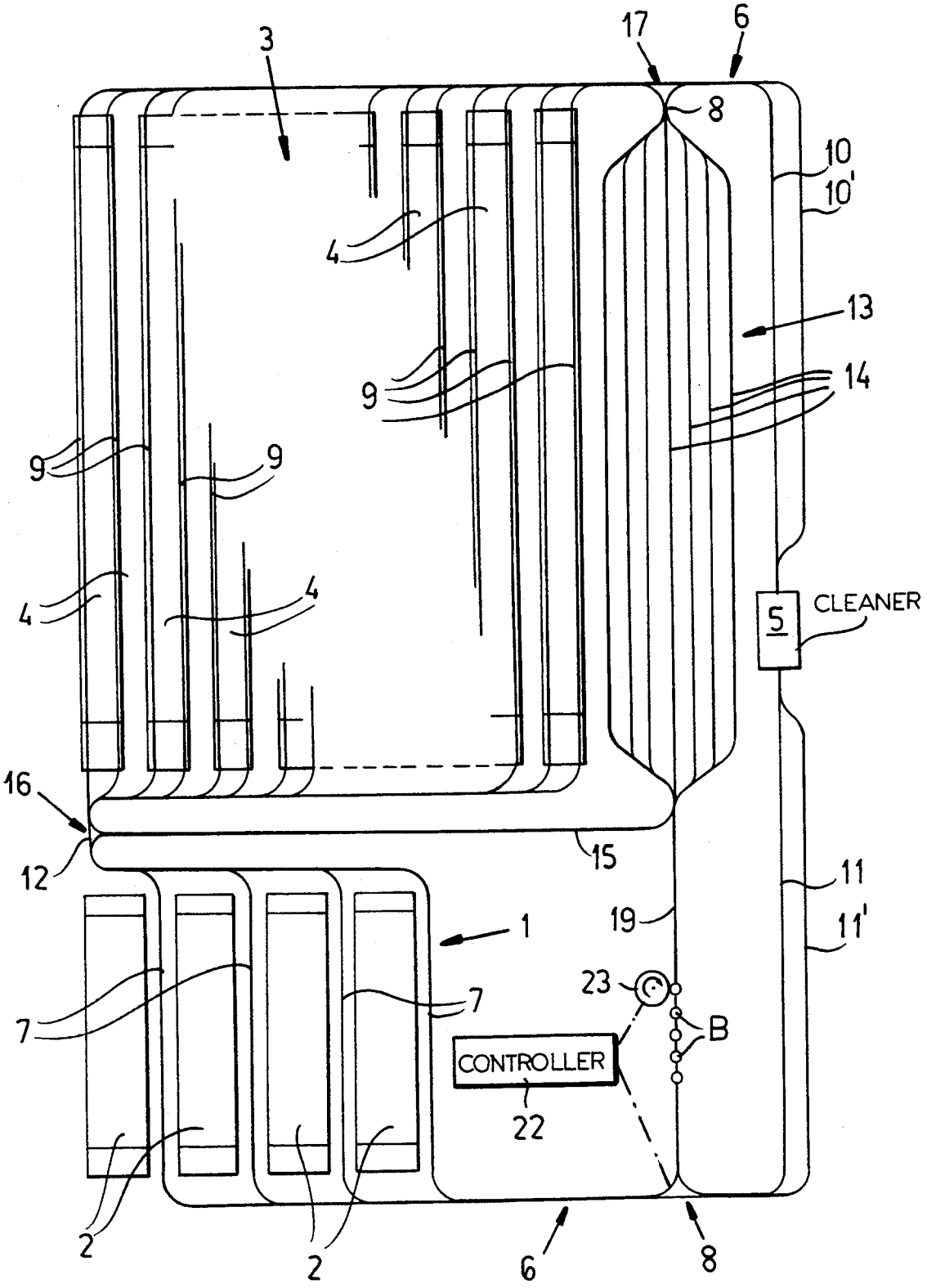
FIG. 1 is a schematic top view of the system of this invention.

As seen in FIG. 1 a spinning mill has a flyer subsystem 1 having a plurality of flyers 2, a ring-spinning subsystem 3 with a plurality of ring spinners 4, and a cleaning unit 5. An annular track 6 has track sections 7 extending along the flyers 2 and sections 9 extending along the ring spinners 4. In addition this track 6 has a section 12 extending from the flyer system 1 to the ring-spinner system 3, a section 10 extending from the ring-spinner system 3 to the cleaner 5, and a section 11 extending from the output of the cleaner 5 to the input side of the flyer system 1. Auxiliary sections 10' and 11' are provided in parallel with downstream and upstream portions of the track sections 10 and 11 in case they get jammed. In other words these sections 10' and 11' serve no storage function but only work as alternate routes when the corresponding sections 10 or 11 become unusable.

An unillustrated automatic transfer device or a machine operator takes empty bobbins B off the track sections 7, loads them into the flyers 2 where they are wound with roving, and then rehangs the full bobbins on the tracks 7. Similarly in the system 3 another automatic transfer device of standard construction or another machine operator takes the roving bobbins B off the track sections 9 and puts them in the ring-spinners 4 which pull the roving off them, and then the substantially empty spools B, which each typically carry a small amount of roving, are hung back up on the track sections 9. The cleaner device 5 is normally provided with a vacuum arrangement that sucks roving scraps off the bobbins B as they pass through it. All this equipment is fairly standard and is described in considerable detail in the above-mentioned patent documents and references.

According to this invention a single central storage unit 13 comprising a plurality of track sections 14 is provided within the perimeter defined by the track 6. This storage unit 13 has one side connected by a short two-way feed track 8 at a three-point intersection switch 17 to the track section 10 and another side connected by respective two-way feed tracks 15 and 19 to respective three-point intersection switches 16 and 18 in the track sections 12 and 11.

A controller 22 is connected to drives such as shown schematically at 23 for moving the bobbins B along the various track sections 7, 8, 9, 10, 11, 12, 15, and 19 and also is connected to each of the switches 16, 17, and 18 for directing full and empty bobbins B where they are supposed to go. Thus when, for instance, the flyers 2 output bobbins B at a rate different from that the spinners 4 need, some of them are fed via the switch 12 to the storage tracks 14 where they are held and they are subsequently sent back out the feed track 15 and through the switch 16 to the flyer tracks 9 where production is much slower. Similarly, for example, during a lull in the output of the flyers 4, bobbins B needing cleaning can be fed via the feed track 8 to the cleaner 5 and cleaned bobbins that cannot be accommodated by the flyers 7 are taken in at switch 18 and fed via the track 19 to the buffer unit 13.

In a specific example the flyer system 1 has 120 spindles so that it can output at one time a so-called train of 120 full roving bobbins. The ring-spinning system 3 has 1200 spindles so that it needs five such trains for supplying one side with full bobbins. In order to fully supply one side of a spinning machine 4, four such trains are held in the storage facility 13 and are combined with a fifth train from the system 1 to fill the system 3.

Figure 2:
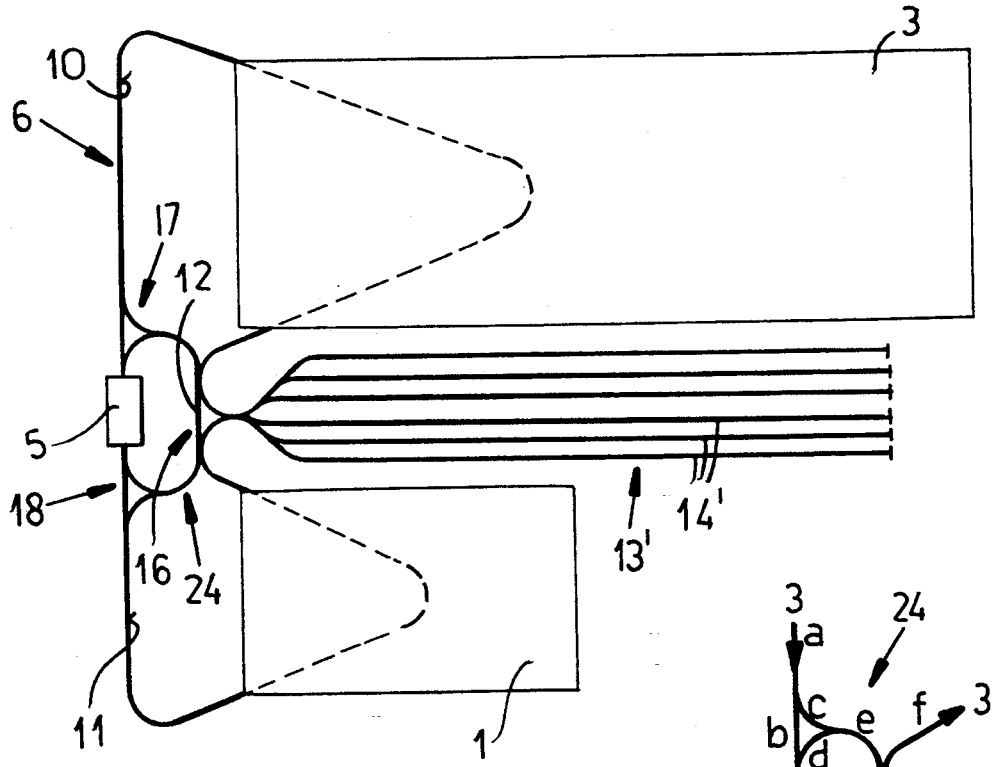
FIG. 2 is a schematic top view of another system.

FIG. 2 shows an arrangement where a storage buffer 13' comprised of blind or single-ended track sections 14' is connected at a node 24 comprised of the three switches 16, 17, and 18 to the flyer system 1, spinner system 3, and cleaner 5. The storage unit 13' lies between the systems 1 and 3 and not within the outline of the track 6.

Figure 3:
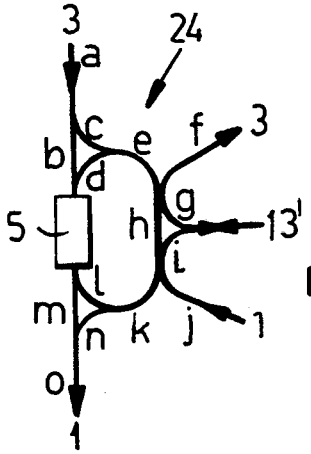
FIG. 3 is a large-scale schematic view of a detail of FIG. 2.

The various path sections into and through the node 24 are identified at a through o in FIG. 3. The paths followed by bobbins B are as follows:

For a group or train of full roving bobbins from the flyer system 1 directly to the spinner system 3: 1-j-h-f-3 and from the flyer system 1 via the buffer 13' to the spinner system 3 it is: 1-j-i-13'-g-f-3.

For a group or train of empty bobbin sleeves from the spinner system 3 directly to the cleaner 5: 3-a-b-5 and from the system 3 to the cleaner 5 via the buffer 13' it is :3-a-c-e-g-13'-g-e-d-5.

For a group or train of cleaned sleeves from the cleaner 5 directly to the flyer system 1: 5-m-o-1 and from the cleaner 5 to the system 1 via the buffer 13' it is: 5-1-k-i-13'-i-k-n-o-1.

Figure 4:
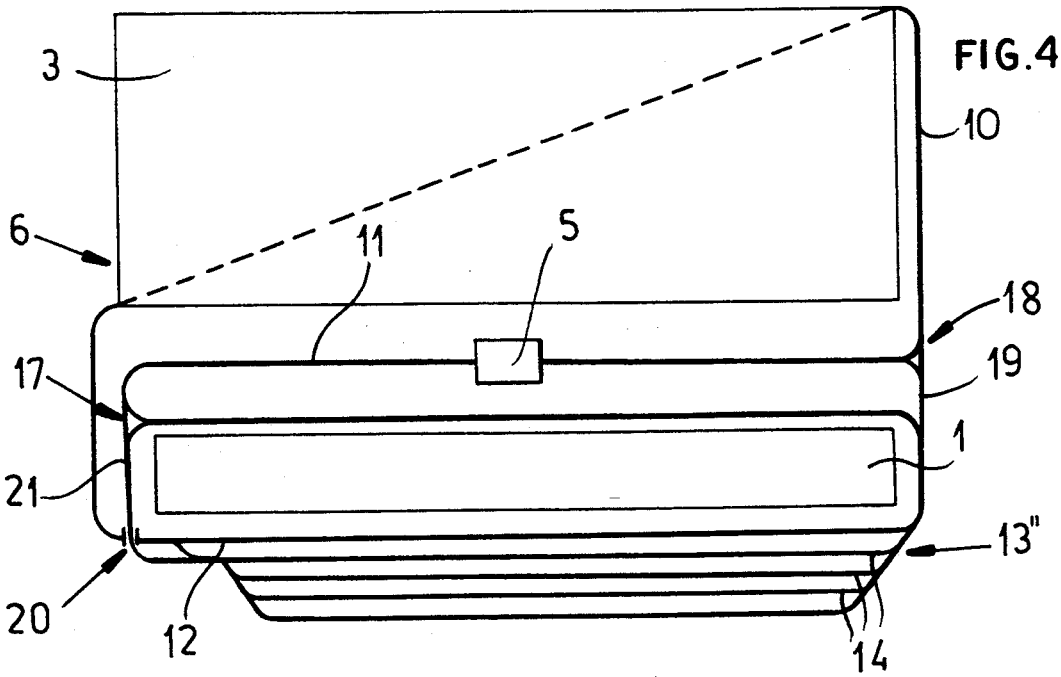
FIG. 4 is a schematic top view of yet another system.

FIG. 4 shows a spinning-mill setup where a buffer 13' is provided wholly outside the track 6, here parallel to the flyer system 1. Thus no switch 16 is necessary, and a connector track 21 is provided that is bridged over the track 6 at 20.

In all systems a fairly large buffer, one big enough to take up the difference between the production rates of the systems 1 and 3 is connected to each leg of the annular track so that this one buffer can service every subassembly of the plant. Thus the capacity of this buffer need merely be slightly more than the size of the buffer normally provided between the systems 1 and 3.

I claim:

1. A conveyor-storage system for moving bobbins in a spinning plant between a fly frame, a ring-spinning frame, and a bobbin cleaner, the system comprising:

an annular single track having a first section extending from the fly frame to the ring-spinning frame, a second section extending from the ring-spinning frame to the cleaner, and a third section extending from the cleaner to the fly frame;

drive means for moving bobbins along the sections of the annular track in only one direction between the frames and cleaner;

a single large-capacity storage area immediately adjacent the track and having respective first, second, and third feed tracks extending to the respective track sections;

respective first, second, and third three-point intersections connecting each feed track with the respective track section; and drive means for moving bobbins between the feed tracks and the respective track sections in each of two opposite directions.

2. The conveyor-storage system defined in claim 1 wherein the storage area lies wholly within the annular track.

3. The conveyor-storage system defined in claim 1 wherein the storage area has a plurality of track sections from which the bobbins hang.

4. The conveyor-storage system defined in claim 1, further comprising control means for operating both of the drive means and the intersections for moving the bobbins.

* * * * *